US006108508A

United States Patent [19]

Takeuchi et al.

[11] Patent Number: 6,108,508

[45] **Date of Patent: *Aug. 22, 2000**

[54] IMAGE FORMING APPARATUS USING WET TYPE DEVELOPING DEVICE

[75] Inventors: Noriyasu Takeuchi, Kanagawa; Masahiko Itaya; Yuichi Aoyama, both of Tokyo; Katsuaki Miyawaki, Kanagawa; Makoto Obu, Kanagawa; Mie Yoshino, Kanagawa, all of Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/222,784

[22] Filed: Dec. 30, 1998

[30] Foreign Application Priority Data

| | | | |
|---|---|---|---|
| Jan. 8, 1998 | [JP] | Japan | 10-013158 |
| Jan. 14, 1998 | [JP] | Japan | 10-017650 |
| Sep. 24, 1998 | [JP] | Japan | 10-270207 |

[51] Int. Cl.[7] ..... G03G 15/10

[52] U.S. Cl. ..... 399/238; 399/239

[58] Field of Search ..... 399/237, 248, 399/238, 239, 250; 430/117, 118; 222/DIG. 1, 145.5, 145.1; 101/350, 363, 367, DIG. 37

[56] References Cited

U.S. PATENT DOCUMENTS

| | | | |
|---|---|---|---|
| 3,406,660 | 10/1968 | Simm | 399/239 X |
| 3,973,699 | 8/1976 | Cook | 222/108 |
| 5,153,659 | 10/1992 | Maiefski et al. | 399/238 X |
| 5,156,308 | 10/1992 | Aoyama | 222/145.5 |
| 5,248,647 | 9/1993 | Aoyama | 399/238 |
| 5,477,313 | 12/1995 | Kuramochi et al. | 399/239 |
| 5,561,264 | 10/1996 | Iino et al. | 399/240 |
| 5,596,396 | 1/1997 | Landa et al. | 399/237 |
| 5,652,080 | 7/1997 | Yoshino et al. | 430/119 |
| 5,666,616 | 9/1997 | Yoshino et al. | 399/240 |
| 5,708,937 | 1/1998 | Lestrange et al. | 399/239 |
| 5,708,938 | 1/1998 | Takeuchi et al. | 399/250 |
| 5,826,148 | 10/1998 | Iino et al. | 399/239 X |

FOREIGN PATENT DOCUMENTS

| | | |
|---|---|---|
| 0 727 720 | 8/1996 | European Pat. Off. . |
| 2 305 765 | 10/1976 | France . |
| 63-074083 | 4/1988 | Japan . |
| 2-306275 | 12/1990 | Japan . |
| 1 456 380 | 11/1976 | United Kingdom . |
| WO 95/10801 | 4/1995 | WIPO . |

*Primary Examiner*—Sophia S. Chen

*Attorney, Agent, or Firm*—Oblon, Spivak, McClelland, Maier & Neustadt, P.C.

[57] ABSTRACT

In an image forming apparatus, a developing device includes a reservoir storing a viscous and dense developing liquid. A developing sleeve, an applicator roller, a circulation pump for circulating the liquid and a screw for agitating the liquid are disposed in the reservoir. The reservoir is open only at its portion where the developing sleeve contacts an image carrier. The liquid is agitated by the screw before flowing into the circulation pump and then applied to the applicator roller. As a result, the liquid is fed to the developing sleeve via the applicator roller with a uniform toner content. The apparatus is small size and stably forms high quality images.

17 Claims, 6 Drawing Sheets

IMAGE FORMING APPARATUS USING WET TYPE DEVELOPING DEVICE

BACKGROUND OF THE INVENTION

The present invention relates to a copier, facsimile apparatus, printer or similar image forming apparatus and more particularly to an image forming apparatus of the type developing a latent image electrostatically formed on an image carrier with a viscous and dense developing liquid.

Image forming apparatuses of the type described are disclosed in, e.g., Japanese Patent Laid-Open Publication Nos. 7-152254, 7-209922 and 7-219355. In the apparatuses taught in these documents, charging means uniformly charges the surface of a photoconductive element. Writing means exposes the charged surface of the element in accordance with image data in order to electrostatically form a latent image. A developing device includes a reservoir or tank storing a viscous and dense developing liquid and develops the latent image with the liquid to thereby produce a corresponding toner image. The developing liquid is implemented by a carrier liquid and toner dispersed in the carrier liquid with a high content. The carrier liquid is dimethyl polysiloxane or similar insulative liquid. The developing liquid is adjusted to have a viscosity as high as 100 Pa·s to 10,000 Pa·s.

The developing liquid is applied to the surface of a developing roller or that of a developing sleeve included in the developing device, forming a thin layer of uniform thickness. The developing roller, for example, conveys the developing liquid to a developing region where it faces the photoconductive element. At the developing region, the developing liquid develops the latent image formed on the photoconductive element to thereby produce a corresponding toner image. The developing liquid left on the developing roller is removed by a blade and then collected in the reservoir. The toner image is transferred from the photoconductive element to a paper or similar recording medium and then fixed on the recording medium by a fixing device. The toner remaining on the photoconductive element after the image transfer is removed by cleaning means.

Specifically, in the developing device taught in the above Laid-Open Publication No. 7-209922, a double-gear pump is disposed in a reservoir storing a developing liquid. A developing roller is located outside of and above the reservoir. The double-gear pump pumps the developing liquid and applies it to the developing roller. As a result, the liquid forms a thin layer on the developing roller.

In the developing device proposed in the above Laid-Open Publication No. 7-219355, a draw-up roller draws up a developing liquid stored in a reservoir. A regulating roller applies the developing liquid to a developing roller located outside of the reservoir. A screw or a rotatable or pivotable fin is disposed in the reservoir for agitating the developing liquid.

However, each of the conventional developing devices has some problems left unsolved, as follows. Because the developing roller is positioned outside of the reservoir, a broad opening is present on the top of the reservoir. As a result, when the developing device is caused tilt or shake by accident, the developing liquid runs out of the reservoir. This problem is particularly serious when a full-color image is formed by a plurality of developing liquids of different colors. To solve this problem, the reservoir has customarily been provided with a sufficiently great size relative to the amount of the developing liquid to be stored therein. This, however, increases the overall size of the image forming apparatus.

When the developing liquid consisting of the insulative carrier liquid and toner is left unused over a long period of time, it is likely that the carrier liquid and toner are separated from each other or that the toner distribution becomes irregular. Further, because the toner or the carrier liquid is sequentially consumed due to repeated development, a fresh carrier liquid or fresh toner must be replenished in order to readjust the toner content of the developing liquid. The prerequisite with such replenishment is that the developing liquid in the reservoir and the toner or the carrier liquid replenished be uniformly mixed together. However, it is not easy to uniformly mix the dense developing liquid having a viscosity as high as 100 Pa·S to 10,000 Pa·S. As a result, the toner cannot be uniformly dispersed in the carrier liquid. Moreover, the developing liquid left on the photoconductive element after development is also collected in the reservoir and must be mixed with the developing liquid present in the reservoir as uniformly as the toner or the carrier liquid replenished. It is, however, extremely difficult to uniformly disperse the toner of the collected developing liquid in the carrier liquid because the toner content of the collected developing liquid has varied in accordance with the image area ratio of a latent image based on image data.

Even when the screw, rotatable or pivotable fin or similar agitating member taught in Laid-Open Publication No. 7-219355 agitates the developing liquid, not the entire liquid but only the liquid around the agitating member moves. Should the developing liquid with an uneven toner content develop a latent image, the resulting toner image would be low quality.

SUMMARY OF THE INVENTION

It is therefore an object of the present invention to provide an image forming apparatus capable being reduced in size.

It is another object of the present invention to provide an image forming apparatus capable of stably forming high quality images.

An image forming apparatus of the present invention includes a reservoir storing a viscous and dense developing liquid for developing a latent image electrostatically formed on an image carrier. A developer carrier deposits the developing liquid thereon. An applicator applies the developing liquid to the developer carrier. A circulation device circulates the developing liquid in the reservoir. An opening is formed in a portion of the reservoir where the developer carrier and image carrier contact each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
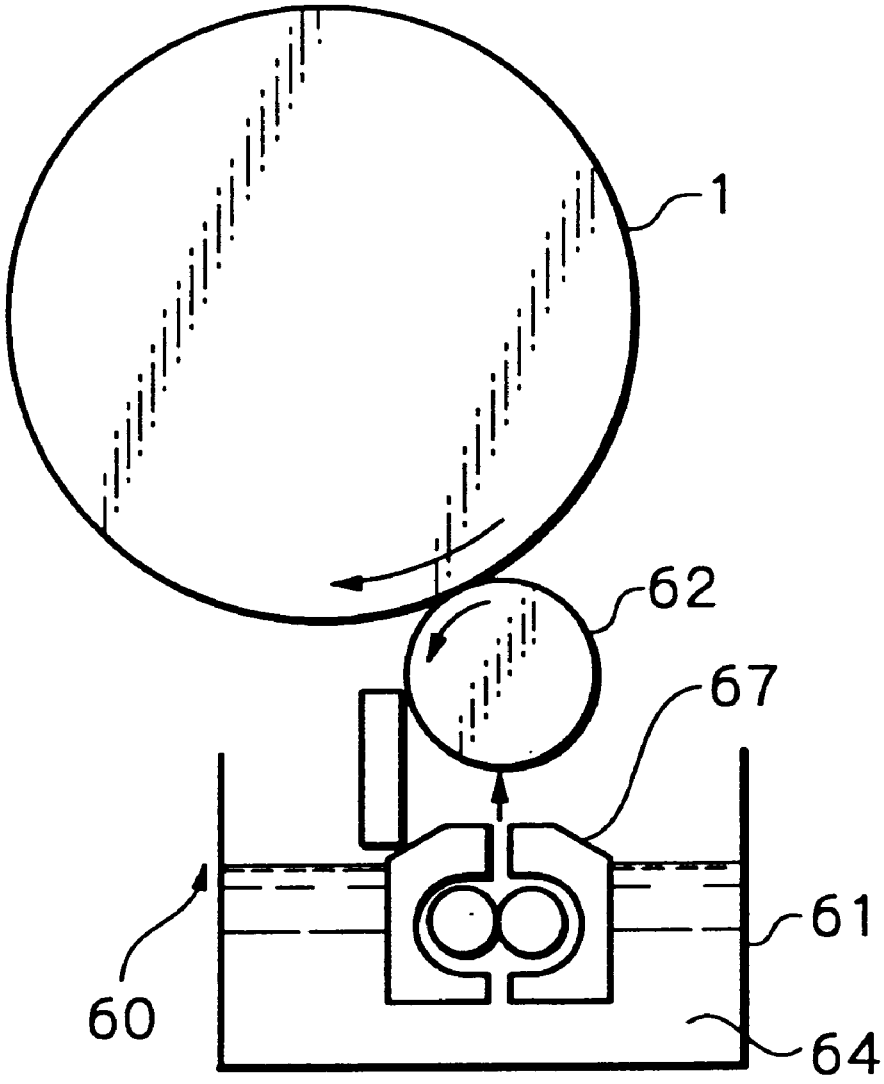
Fig. 1 PRIOR ART
FIG. 1 shows a conventional developing device using a developing liquid.

To better understand the present invention, brief reference will be made to a developing device taught in Japanese Patent Laid-Open Publication No. 7-209922 mentioned earlier. As shown in FIG. 1, the developing device, generally 60, includes a reservoir or tank 61 storing a developing liquid 64. A double-gear pump 67 is disposed in the reservoir 61. A developing roller 62 is located outside of and above the reservoir 61. The double-gear pump 67 pumps the developing liquid 64 and applies it to the developing roller 62. As a result, the liquid 64 forms a thin layer on the developing roller 62 and is applied to a photoconductive drum 1 by the roller 62.

The developing roller 62 is positioned outside of the reservoir 61, as stated above. That is, a broad opening is present on the top of the reservoir 61. As a result, when the developing device 60 is caused to tilt or shake by accident, the developing liquid 64 runs out of the reservoir 61. This problem is particularly serious when a full-color image is formed by a plurality of developing liquids of different colors, as discussed earlier.

Figure 2:
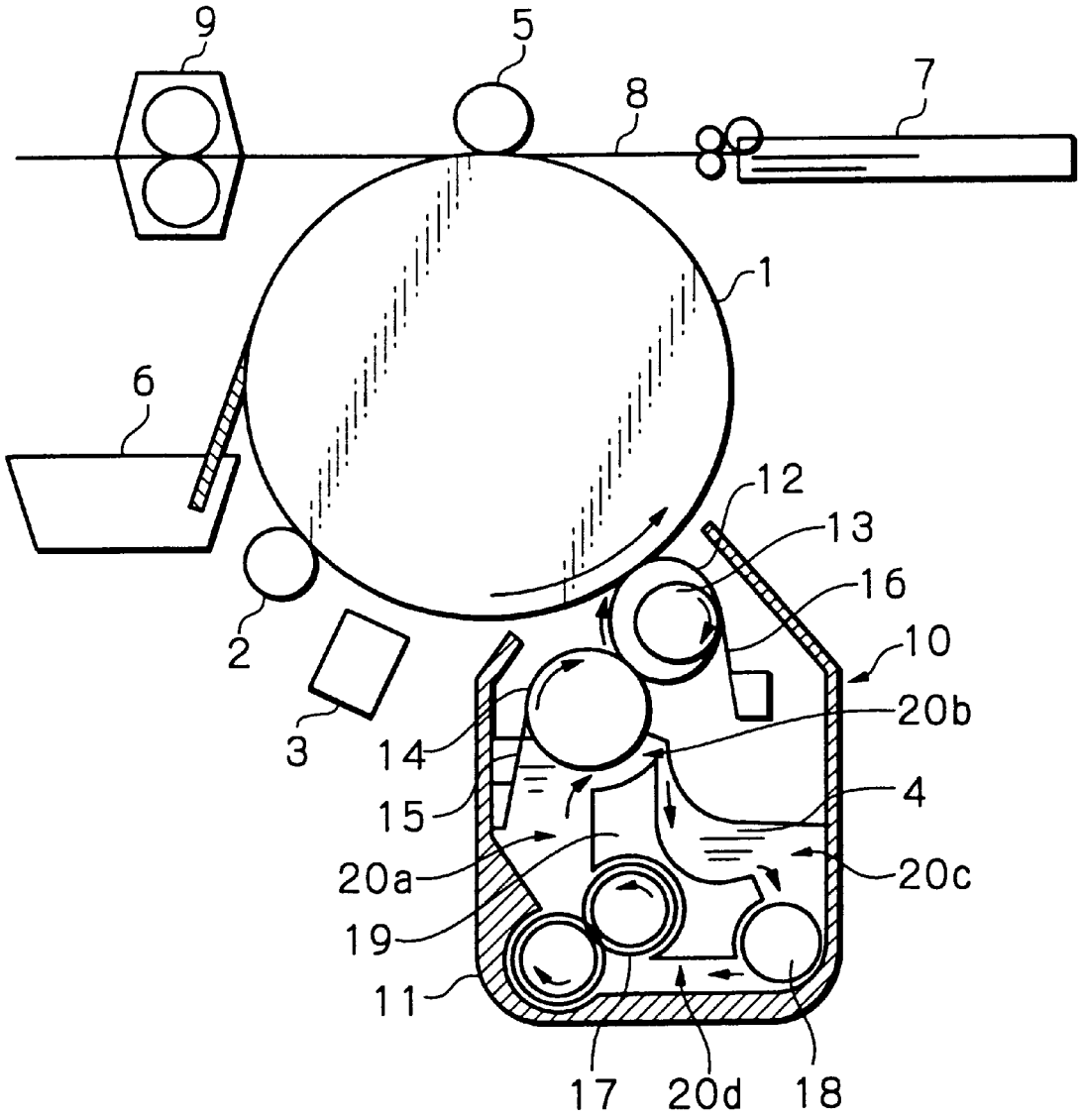
FIG. 2 shows a first embodiment of the image forming apparatus using a liquid in accordance with the present invention.

Referring to FIG. 2, a first embodiment of the image forming apparatus using a developing liquid in accordance with the present invention is shown. The illustrative embodiment is implemented as an electrophotographic copier by way of example. As shown, the copier includes a photoconductive element or image carrier implemented as a drum 1. Arranged around the drum 1 are a charge roller or charging means 2, optics or writing means 3, a developing device or developing means 10, an image transfer device or image transferring means 5, and a cleaning device or cleaning means 6. A paper or similar recording medium 8 is conveyed from a paper feed section 7 to a fixing device 9 via the image transfer device 5 along a preselected transport path.

After the charge roller 2 has charged the surface of the drum 1, the optics 3 exposes the charged surface of the drum 1 with light imagewise to thereby form an electrostatic latent image. The developing device 5 develops the latent image with a developing liquid 4 stored therein. In the illustrative embodiment, the developing liquid 4 consists of a carrier liquid implemented by dimethyl polysiloxane oil or similar insulative liquid and toner dispersed in the carrier liquid with a high content. The liquid 4 is so adjusted as to have a viscosity as high as 100 Pa·s to 10,000 Pa·s. A toner image formed on the drum 1 by the liquid 4 is transferred to the paper 8 fed from the paper feed section 7 by the image transfer device 5. The paper 8 with the toner image is conveyed to the fixing device 9 and has its toner image fixed by heat and pressure thereby. The developer left on the drum 1 after the image transfer is removed by the cleaning device 6. Such a procedure is repeated thereafter.

The developing device 10 includes a reservoir 11 storing the developing liquid 4. A developing sleeve or developer carrier 12, a drive roller or drive means 13, an applicator roller or applying means 14, a metering blade or regulating member 15, a collecting blade 16, a circulation pump or circulating means 17 and a screw or agitating means 18 are disposed in the reservoir 11 The drive roller 13 drives the developing sleeve 12. The metering blade 15 regulates the amount of the developing liquid 4 to deposit on the applicator roller 14. The collecting blade 16 collects the liquid 4 left on the developing sleeve 12. The circulation pump 17 circulates the liquid 4 in the reservoir 11. The screw 18 agitates the liquid 4. The reservoir 11 is open only at its portion where the developing sleeve 12 contacts the drum 1. A partition 19 is also disposed in the reservoir 11 and extends in the axial direction of the applicator roller 14. In this configuration, the liquid 4 is circulated in the reservoir 11.

Specifically, the partition 19 divides the reservoir 11 into a feed section 20*a* for feeding the developing liquid 4 to the applicator roller 14 and a collection section 20*c* for collecting the liquid 14 left on the developing sleeve 12. A communication section 20*d* is formed beneath the partition 19, i.e., at the bottom of the reservoir 11 and provides fluid communication between the feed section 20*a* and the collection section 20*c*. Further, a return section 20*b* is formed above the partition 19, i.e., between the partition 19 and the applicator roller 14 for returning the developing liquid 4 not deposited on the applicator roller 14 to the collection section 20*c*. In this manner, a circulation path is formed in the reservoir 11 between the inner periphery of the reservoir 11 and the partition 19.

The circulation pump 17 is positioned at the boundary between the feed section 20*a* and the communication section 20*d*. In the illustrative embodiment, the circulation pump 17 is implemented by a gear pump to be driven by an electric motor not shown. If desired, the gear pump may be replaced with, e.g., a combination of a check valve and a piston for compressing a fluid so long as it is capable of causing the developing liquid 4 to flow. The circulation pump 17 causes the developing liquid 4 in the reservoir 11 to sequentially circulate through the feed section 20*a*, return section 20*b*, collection section 20*c* and communication section 20*d* in this order.

The applicator roller 14 is positioned above the feed section 20*a* in the reservoir 11. The metering blade 15 is affixed to a portion of the inner periphery of the reservoir 11 facing the applicator roller 14. The metering blade 15 regulates the developing liquid 4 deposited on the applicator roller 14 to a preselected thickness.

The developing sleeve 12 is implemented by a hollow cylindrical elastic member and held in contact with the applicator roller 14 and drum 1. The drive roller 13 causes the developing sleeve 12 to rotate at the same peripheral speed and in the same direction as the drum 1. The collecting blade 16 is positioned above the collection section 20*c* and held in contact with the developing sleeve 12. The drive roller 13 contacts a portion of the inner periphery of the developing sleeve 12 facing the collecting blade 16. That is, the drive roller 13 and collecting blade 16 sandwich the above part of the developing sleeve 12.

In the illustrative embodiment, the screw or agitator 18 is implemented by two coaxial rollers arranged in the axial direction of the developing sleeve 12. The coaxial rollers have a spiral sleeve arranged thereon. The screw 18 in rotation moves the developing liquid 4 toward the center in the axial direction of the developing sleeve 12. The screw 18 is positioned between the collection section 20*c* and the communication section 20*d*.

The developing liquid 4 existing in the reservoir 11 sequentially decreases in amount due to repeated development. It is therefore necessary to replenish a fresh developing liquid or fresh toner or fresh carrier liquid so as to readjust the developing liquid. For this purpose, the developing device 10 is formed with a replenishment port, not shown, for the replenishment of a developing liquid or toner or carrier liquid. In the illustrative embodiment, replenishment port is positioned in the collection section 20*c*.

The configuration of the developing device 10 will be described more specifically hereinafter together with the operation of the device 10. The developing liquid 4 in the feed section 20*a* is pumped upward by the circulation pump 17 and then deposited on the applicator roller 14. The liquid 4 is transferred from the applicator roller 14 to the developing sleeve 12 while being regulated to a preselected thickness by the metering blade 15. The liquid 4 forming a thin layer on the developing sleeve 12 deposits on a latent image formed on the drum 1 at a developing region where the sleeve 12 and drum 1 face each other, thereby transforming the latent image to a corresponding toner image. Specifically, an electric field for development is formed in the above developing region in accordance with the potential distribution of the latent image. As a result, both the carrier liquid and the toner present in the thin layer are transferred at image portions, but only the carrier liquid is slightly transferred at non-image portions or background. The background therefore suffers from a minimum of contamination.

The collecting blade 16 scrapes off the developing liquid 4 left on the surface of the developing sleeve 12 moved away from the developing region. The liquid 4 removed by the blade 16 drops into the collection section 20*c* and is again used for development.

In the illustrative embodiment, the developing liquid 4 consists of an insulative carrier liquid and toner dispersed in the carrier liquid, as stated earlier. Therefore, should the liquid 4 be left unused in the reservoir 11 for a long period of time, the toner would precipitate and its content would become irregular in the up-and-down direction within the reservoir 11; i.e., the toner content would increase in the bottom portion of the reservoir 11. In light of this, the screw 18 is positioned at the bottom portion of the circulation path and agitates the liquid 4 in the horizontal direction. As a result, the toner content is uniformed in the axial direction of the sleeve 12. Further, because the screw 18 is positioned upstream of the circulation pump 17 in the direction of circulation, the liquid 4 having the uniform toner content in the horizontal direction can be fed to the pump 17.

In the illustrative embodiment, the circulation pump 17 not only causes the developing liquid 4 to flow, but also increases the flow rate of the liquid 4. Therefore, the liquid 4 flowing into the pump 17 is forcibly caused to flow. As a result, the liquid 4 in the feed section 20*a* downstream of the pump 17 in the direction of circulation is agitated in the vertical direction. In addition, the outlet of the pump 17 is narrower than the circulation path, as shown in FIG. 2. It follows that the liquid 4 flowing out via the outlet of the pump 17 is scattered in the feed section 20*a*, so that the liquid 4 in the feed section 20*a* is agitated.

As stated above, the liquid 4 in the reservoir 11 is agitated in both of the horizontal and vertical directions thereby providing uniform toner content. The liquid 4 with such a uniform toner content is fed to the applicator roller 14. On the other hand, the liquid 4 not fed to the applicator roller 14 flows along the partition 19 and returns to the collection section 20*c* via the return section 20*b*.

For the illustrative embodiment to form an attractive image, it is necessary that the developer deposited on the developing sleeve 12 in the form of a thin layer be uniform in toner content and thickness. Usually, however, the applying means is implemented by a roller having a smooth surface as used in a printer also. When a liquid is applied to a belt-like or roller-like member by the roller having a smooth surface, a liquid layer intervening between the above member and the roller is apt to split into two layers when released. As a result, fine irregularities called voids (dot-like irregularities) or ribs (circumferential stripes) occur on the surfaces of the above layer due to cavitation. The fine irregularities depend not only on the viscosity and surface tension of the liquid but also on the linear velocity and contact pressure of the roller and, e.g., the belt-like member. It is therefore difficult to form a fully flat surface.

Further, the liquid 4 is applied to the surface of the developing sleeve 12 in an amount that is control led by the contact pressure and relative speed between the applicator roller 14 and, e.g., the belt-like member. Therefore, if the applicator roller 14 has a smooth surface, then the thin layer of the liquid 4 cannot be accurately controlled on the order of micrometers unless the deviation of the axis of the roller 14 and the pressure of the roller 14 acting on the sleeve 12 are strictly controlled. This, coupled with the fact that the applicator roller 14 should be machined with high accuracy as to circularity, error in circumference, surface roughness and so forth, sophisticates machining and therefore increases the cost.

To form a uniform liquid layer on the developing sleeve 12 while solving the above problems, the applicator roller 14 of the illustrative embodiment is implemented as a photogravure roller having a carved surface. With the carved surface, the roller 14 is capable of holding a sufficient amount of the liquid 4 and even allows an excess liquid to deposit thereon. The excess liquid deposited on the roller 14 is removed between the roller 14 and the metering blade 15. This successfully controls the amount of the liquid 4 to deposit on the surface of the roller 14 with accuracy.

In the illustrative embodiment, the applicator roller 14 is caused to move in the opposite direction to the developing sleeve 12, as seen at the nip between the roller 14 and the sleeve 12, thereby obviating the fine irregularities mentioned earlier. Furthermore, in the illustrative embodiment, the roller 14 is caused to rotate at a higher linear velocity than the sleeve 12 in order to insure the uniform thickness of the liquid layer despite the carved surface of the roller 14.

With the above configuration, it is possible to maintain the liquid layer formed on the developing sleeve 12 uniform in thickness.

Figure 3:
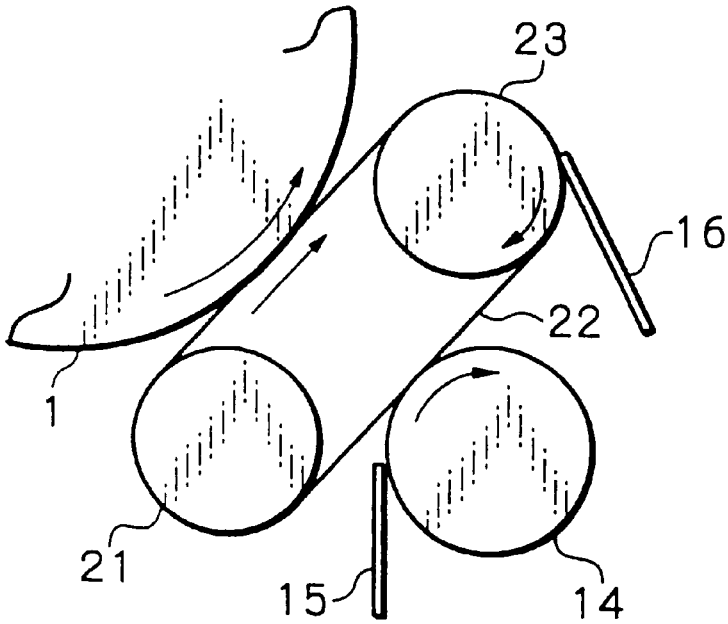
FIG. 3 shows a comparative example of a developing sleeve included in the illustrative embodiment.

In the illustrative embodiment, the drive roller 13 causes the developing sleeve 12 to rotate while carrying the thin liquid layer having the uniform thickness. As shown in FIG. 3, assume that a developing belt 22 is substituted for the developing sleeve 12. Then, the belt 22 must be rotated with a drive roller 23 and a driven roller 21 applying tension to the belt 22. In this case, the drive roller 23 and driven roller 21 positioned at the inside of the belt 22 increase the overall size of the image forming apparatus. In addition, to prevent the belt 22 from being displaced in the axial direction, it is necessary to maintain the two rollers 23 and 21 precisely parallel to each other.

In light of the above, in the illustrative embodiment, the drive roller 13 contacting the inner periphery of the developing sleeve 12 and the collection blade 16 contacting the outer periphery of the sleeve 12 sandwich the sleeve 12. At the position where the roller 13 and blade 16 sandwich the sleeve 12, a sufficient degree of friction acts between the roller 13 and the sleeve 12 and allows the sleeve 12 to rotate. In addition, such a simple structure reduces the size of the developing device. To prevent the sleeve 12 from being displaced, the roller 13 and blade 16 should only be maintained parallel to each other. This is easier to practice than in the configuration shown in FIG. 3.

The developing sleeve 12 and applicator roller 14 contact each other at a position other than the above sandwiching position, i.e., at a position where a space is available between the sleeve 12 and the drive roller 13. Therefore, the contact pressure between the roller 14 and the sleeve 12 can be control led without being noticeably effected by the mechanical accuracy of the roller 14 and sleeve 12. It follows that the roller 14 and sleeve 12 may be machined with relatively low accuracy.

Figure 4:
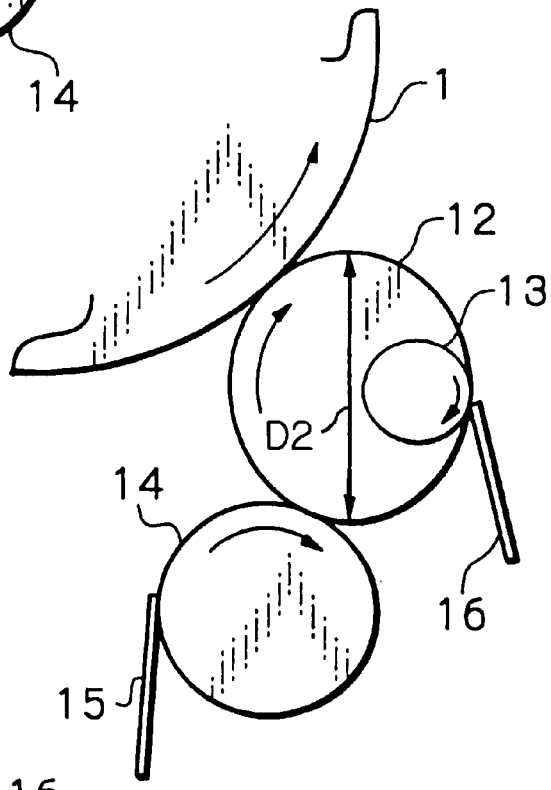
FIGS. 4 and 5 respectively show a case wherein the diameter of a drive roller included in the illustrative embodiment is less than ½ of the inside diameter of a developing sleeve also included in the illustrative embodiment, and a case wherein the former is greater than 9/10 of the latter.
Figure 5:
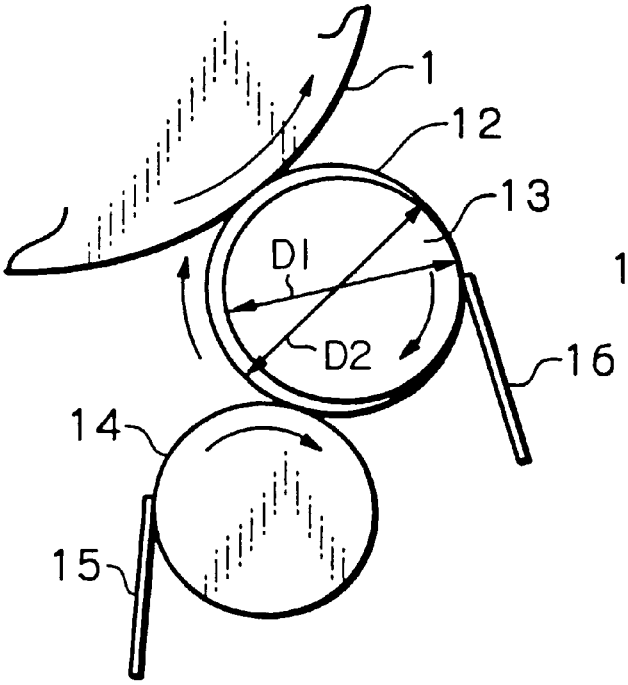

The drive roller 13 has a diameter DI that should preferably be greater than ½ inclusive, but smaller than 9/10 inclusive, of the inside diameter D2 of the developing sleeve 12. This is because as the diameter D1 becomes closer to the inside diameter D2, i.e., as a difference (D2–D1) decreases, the sleeve 12 can be driven more stably. However, if the difference (D2–D1) is excessively small, then the space between the sleeve 12 and the roller 13 decreases and prevents the sleeve 12 and drum 1 and the sleeve 12 and applicator roller 14 from adequately contacting each other. Specifically, as shown in FIG. 4, when the diameter D1 of the drive roller 13 is less than ½ of the inside diameter D2 of the sleeve 12, the drive of the sleeve 12 becomes unstable. On the other hand, as shown in FIG. 5, when the diameter D1 is greater than 9/10 of the inside diameter D2, a sufficient nip width is not available between the sleeve 12 and the drum 1 or between the sleeve 12 and the roller 14. This is why the diameter D1 is selected to be between ½ and 9/10 of the inside diameter D2.

The reservoir 11 is open only at its portion where the developing sleeve 12 contacts the drum 1, i.e., accommodates the structural elements therein except for a part of the sleeve 12. It follows that when the developing device 10 is caused to tilt or shake by accident, it is least probable that the developing liquid 4 runs out of the reservoir 11, compared to the conventional developing device. Further, the metering blade l5 is so positioned as to shield the gap between the inner periphery of the reservoir 11 and the applicator roller 14. This limits the space via which the liquid 4 may run out of the reservoir 11 only to the extremely small gap between the inner periphery of the reservoir 11 and the sleeve 12. This further reduces the probability that the liquid 4 runs out of the reservoir 11. The sleeve 12 may be positioned above the roller 14, as in the illustrative embodiment, in order to raise the level of the gap between the reservoir 11 and the sleeve 12. This additionally reduces the probability that the liquid 4 runs out of the reservoir 11.

Moreover, when the circulation pump 17 implemented by a gear pump is not driven, it interrupts fluid communication between the feed section 20*a* and the collection section 20*c* and thereby divides the inside of the reservoir 11 into two sections. In this condition, when the developing device 10 is caused to tilt, the probability that the liquid 4 runs out is lower, for a given amount of the liquid 4, than when the device 10 with the two sections 20*a* and 20*c* communicating with each other is caused to tilt.

Figure 9:
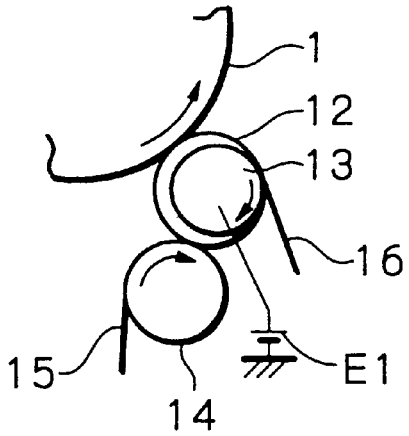
FIG. 9 is a fragmentary view of the second embodiment.

A preselected bias for development is applied to the sleeve 12 and drum 1 in order to form an electric field in the developing region between them. As shown in FIG. 9, in the illustrative embodiment, the sleeve 12 is formed of a conductive material while at least a part of the drive roller 13 contacting the sleeve 12 is formed of a conductive material. A power source E1 applies a voltage to the drive roller 13 for forming the above electric field. Because the sleeve 12 and drive roller 13 contact each other with a preselected pressure, the voltage applied from the power source E1 to the roller 13 deposits the same potential on the sleeve 12 also. Particularly, the sleeve 12 and roller 13 driving the sleeve 12 are so configured at to surely contact each other. Therefore, a stable voltage can be applied to the sleeve 12.

Figure 10:
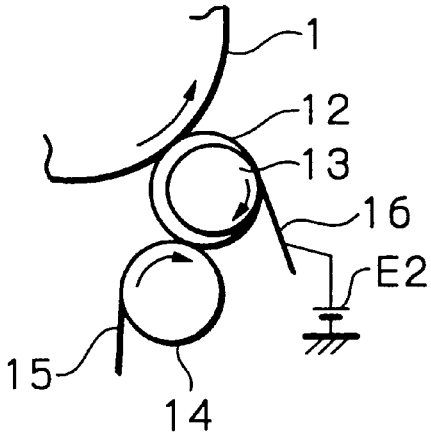
FIGS. 10–13 respectively show a first modification to a fourth modification of a bias applying method available with the second embodiment.

FIG. 10 shows a first modification of the above embodiment in which the electric field of a preselected potential is also applied to the developing region between the drum 1 and the developing sleeve 12. As shown, the collecting blade 16 contacting the sleeve 12 is formed of a conductive material. A power source E2 applies a preselected voltage to the blade 16. The blade 16 not only collects the liquid 4 left on the sleeve 12, as stated earlier, but also presses the sleeve 12 against the drive roller 13. The blade 16 and sleeve 12 are therefore held in contact in an extremely stable condition. It follows that the voltage applied to the blade 16 deposits the same potential on the sleeve 12 also and therefore remains stable.

In the above embodiment and its first modification, the collecting blade 16 is used to press the developing sleeve 12 against the drive roller 13. If desired, the blade 16 may be replaced with a roller facing the drive roller l3 with the intermediary of the sleeve 12 so long as it is capable of pressing the sleeve 12 against the roller 13. Such a roller may be formed of a conductive roller applied with the above voltage. In this case, however, the roller should preferably contact the outer periphery of the sleeve 12 between the position where the residual developing liquid is removed from the sleeve 12 and the position where the liquid is applied by the applicator roller 14. This will allow the roller and sleeve 12 to surely contact each other.

However, the collecting blade 16 used as the pressing means and applied with the voltage, as shown in FIG. 10, advantageously implements a developing device capable of applying a stable voltage with a more compact configuration.

Figure 11:
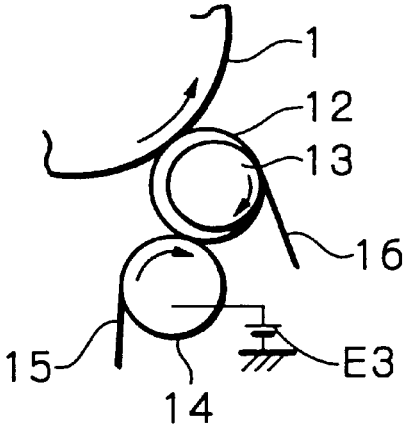

FIG. 11 shows a second modification of the first embodiment in which a preselected voltage is also applied to the developing region between the drum 1 and the developing sleeve 12. As shown, a power source E3 may apply a preselected voltage to the applicator roller 14. The applicator roller 14 is held in contact with the sleeve 12 during development in order to apply the developing liquid 4 to the sleeve 12. Therefore, by applying a preselected voltage to the roller 14, it is possible to maintain the voltage constant.

Figure 12:
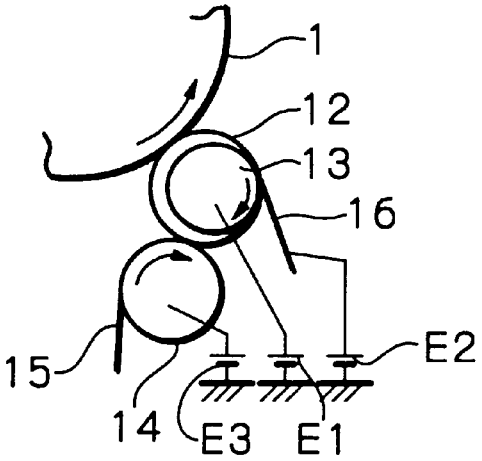

FIG. 12 shows a third modification of the first embodiment. As shown, the power sources E1, E2 and E3 may be suitably combined in order to feed a preselected voltage to the drive roller 13, collecting blade 16, and applicator roller 14.

Figure 13:
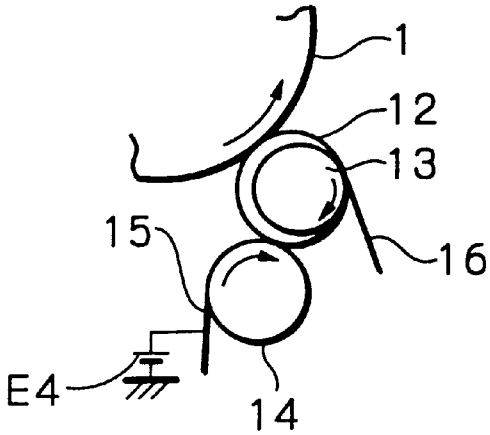

Further, FIG. 13 shows a fourth modification of the first embodiment. As shown, a power source E4 applies a preselected voltage to the metering blade 15 that regulates the amount of the developing liquid 4 to deposit on the applicator roller 14. In this case, the blade 15 is formed of a conductive material. The voltage applied from the power source 4 to the blade 15 remains constant because the blade 15 contacts the roller 14 contacting the sleeve 12.

Particularly, at least the conductive portion of the drive roller 13, collecting blade 16, applicator roller 14 or metering blade 15 may be provided with a volume resistivity less than 108 Ω·cm inclusive. This further stabilizes the application of the voltage to the developing sleeve 12. Consequently, a stable electric field for developing is formed between the developing region between the drum 1 and the sleeve 12, insuring high quality images.

Figure 6:
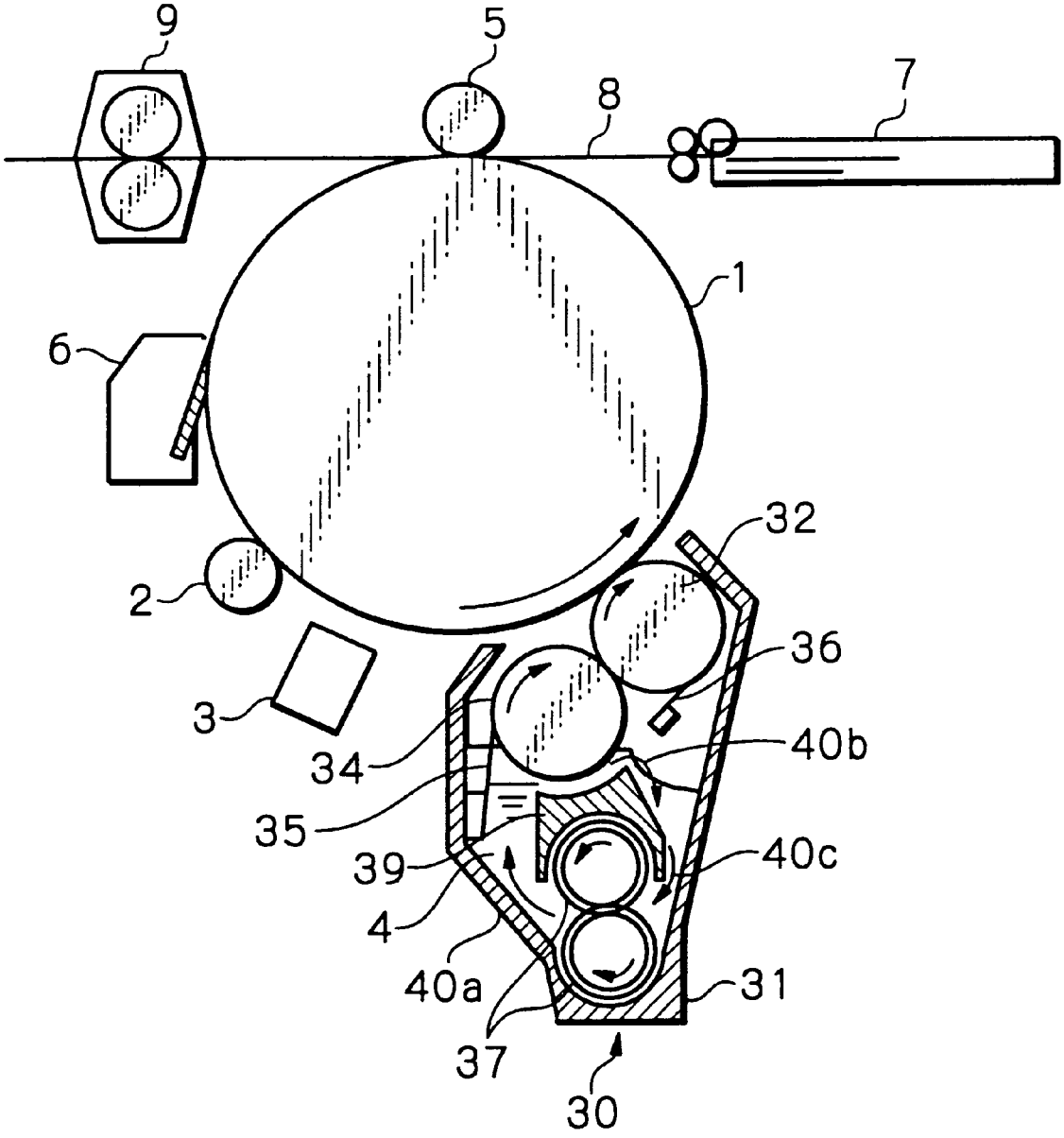
FIG. 6 shows a second embodiment of the present invention.
Figure 7:
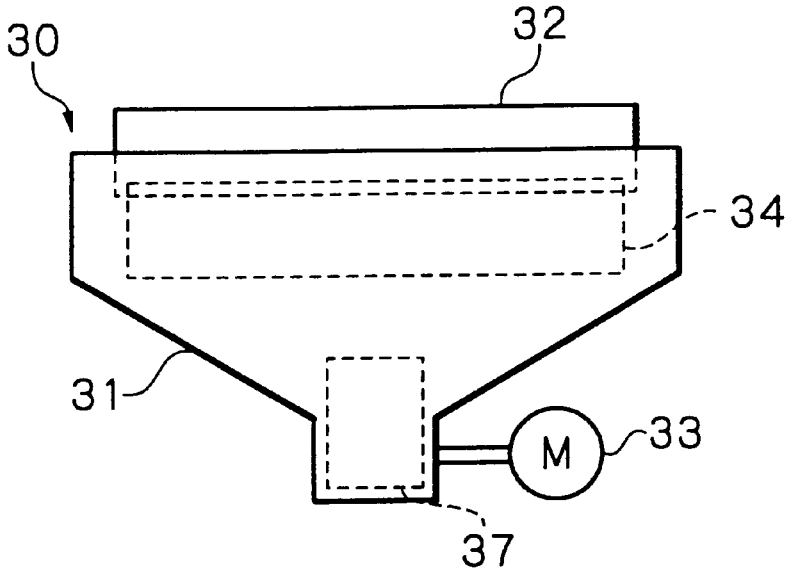
FIG. 7 is a side elevation showing the second embodiment.

Reference will be made to FIGS. 6 and 7 for describing a second embodiment of the present invention. As shown, this embodiment is also implemented as a copier identical in construction with the first embodiment except for the configuration of the developing device. Therefore, the following description will concentrate on the configuration and operation of the developing device.

As shown in FIGS. 6 and 7, a developing device, generally 30, includes a reservoir or tank 31 storing the developing liquid 4. A developing roller or developer carrier 32, an applicator roller or applying means 34, a metering blade or regulating member 35, a collecting blade 36 and a circulation pump or circulating means 37 are disposed in the reservoir 31. The metering blade 35 regulates the amount of the developing liquid 4 to deposit on the applicator roller 34. The collecting blade 36 collects the liquid 4 left on the developing roller 32. The circulation pump 37 is capable of agitating the developing liquid 4 and is driven by an electric motor 33 (see FIG. 7) located outside of the reservoir 31. As shown in FIG. 7, the reservoir 31 has a substantially funnel-like configuration including a restricted portion. The reservoir 31 is open only at its portion where the developing roller 32 contacts the drum 1. As shown in FIG. 6, a partition 39 is positioned at the center portion of the reservoir 31 and extends in the axial direction of the applicator roller 34.

The partition 39 divides the inside of the reservoir 31 into a feed section 40*a* and a collection section 40*c*. The circulation pump 37 is positioned in the above restricted portion forming the bottom portion of the reservoir 31 in the vertical direction. A return section 40*b* is formed above the partition 39, i.e., between the partition 39 and the applicator roller 34. In this configuration, a developer circulation path is formed in the reservoir 31.

The circulation pump 37 is implemented by a gear pump to be driven by the electric motor 33, as in the first embodiment. The pump 37 causes the liquid 4 in the reservoir 31 to sequentially circulate through the feed section 40*a*, return section 40*b* and collection section 40*c* in this order. Further, the motor 33 drives the pump 37 in such a manner as to forcibly cause the liquid 4 to circulate in the reservoir 31.

While the developer carrier is implemented by the developing roller 32, it may, of course, be implemented by a developing sleeve or any one of conventional developer carriers. The applicator roller 34, metering blade 35 and collecting blade 36 are identical with the corresponding structural elements of the first embodiment and will not be described in order to avoid redundancy.

This embodiment differs from the previous embodiment in that the screw 18 for agitating the developing liquid 4 in the horizontal direction in the reservoir is absent. This is because the circulation path includes the horizontally restricted portion positioned at the bottom of the reservoir 31. In this condition, when the circulation pump 37 causes the liquid 4 to flow to the restricted portion by sucking it, the liquid 4 is caused to move in the horizontal direction in the reservoir 31. As a result, the liquid 4 is successfully agitated in the horizontal direction.

The liquid 4 agitated in the horizontal direction flows into the circulation pump 37 and is increased in flow rate thereby. The liquid 4 discharged from the pump 37 at a higher flow rate is forcibly caused to flow and therefore moved and agitated in the vertical direction. Particularly, in the illustrative embodiment, the restricted portion where the pump 37 is positioned serves to noticeably increase the flow rate of the liquid 4. As a result, the liquid 4 discharged from the pump 37 is scattered into the liquid 4 existing in the feed section 40*a* over a broad range. This allows the liquid 4 to be sufficiently agitated in the reservoir 31 without resorting to the screw or similar agitating means of the first embodiment.

Another advantage achievable with the second embodiment is that the structural elements of the developing device 30 can be arranged in the reservoir 31 in a substantially vertical array. The reservoir 31 can therefore be reduced in horizontal dimension, reducing the overall size of the developing device 30.

Figure 8:
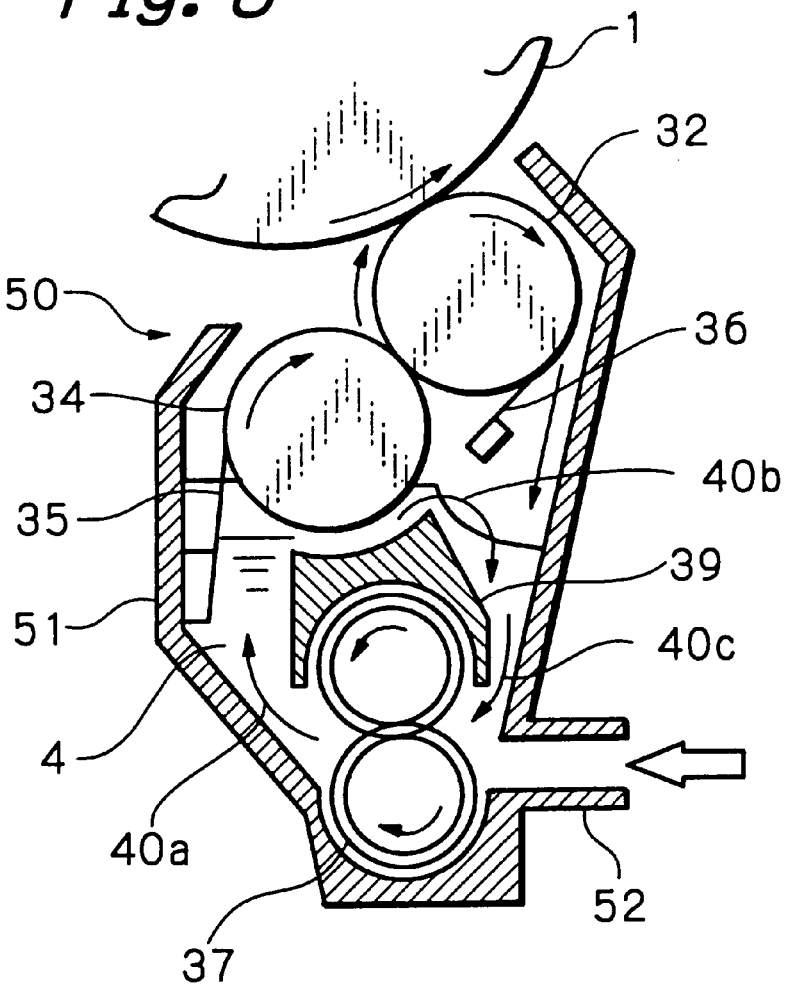
FIG. 8 shows a modification of the second embodiment.

FIG. 8 shows a modified form of the second embodiment. In FIG. 8, structural elements identical with the elements shown in FIG. 6 are designated by like reference numerals. As shown, a developing device 50 includes a reservoir 51 storing the developing liquid 4. A collection section 40*c* formed in the reservoir 51 includes a replenishment port 52 for the replenishment of a developing liquid or toner or carrier liquid. The replenishment port 52 is positioned at the inlet side of the circulation pump 37, so that a developing liquid, for example, can be replenished into the liquid 4 flowing through the circulation path.

The liquid 4 is sufficiently agitated by the circulation pump 37, as stated in relation to the second embodiment. Therefore, the replenishment port 52 positioned at the inlet side of the pump 37 allows the liquid 4 present in the reservoir 51 and, e.g., a developing liquid replenished to be surely mixed with each other. Further, even when the pump 37 fails to pump the liquid 4 due to a decrease in the amount of the liquid 4, a fresh developing liquid can be immediately replenished to the pump 37. This modification may advantageously include a mechanism for sensing the rotation torque of the pump 37 and replenishing a fresh developing developer when the above torque falls below a preselected level.

In summary, it will be seen that the present invention provides a miniature image forming apparatus capable of preventing, when it is caused to tilt or shakes by accident, a developing liquid from running out of a reservoir without resorting to an increase in the size of the reservoir. Further, the apparatus is capable of forming high quality images in a stable manner. The image quality is further enhanced because the liquid is agitated and circulated stably and efficiently. Moreover, the liquid forms a thin layer having a uniform thickness on a developer carrier, additionally enhancing the image quality.

Various modifications will become possible for those skilled in the art after receiving the teachings of the present disclosure without departing from the scope thereof.

What is claimed is:

1. An image forming apparatus comprising:

a reservoir storing a viscous and dense developing liquid for developing a latent image electrostatically formed on an image carrier;

a developer carrier for depositing the developing liquid thereon;

an applicator roller for applying the developing liquid to said developer carrier;

a circulating pump positioned within the reservoir for circulating the developing liquid in said reservoir;

an opening formed in a portion of said reservoir where said developer carrier and said image carrier contact each other; and a partition arranged in said reservoir for separating said reservoir into a feed section for feeding the developing liquid to said applicator roller and a collection section for collecting the developing liquid left on said developer carrier, said circulating pump being configured to force the developing liquid from said collection section to said feed section.

2. An apparatus as claimed in claim 1, wherein said developer carrier and said applicator roller are disposed in said reservoir.

3. An apparatus as claimed in claim 2, wherein said circulating pump is capable of agitating the developing liquid in said reservoir.

4. An apparatus as claimed in claim 3, further comprising a replenishment port for replenishing one of a fresh developing liquid, fresh toner and a fresh carrier liquid.

5. An apparatus as claimed in claim 4, wherein said replenishment port is included in said circulating pump.

6. An apparatus as claimed in claim 2, further comprising agitating means disposed in said reservoir for agitating the developing liquid.

7. An apparatus as claimed in claim 6, wherein said agitating means is positioned upstream of said circulating pump in a direction of circulation of the developing liquid.

8. An apparatus as claimed in claim 2, wherein said circulating pump conveys the developing liquid in a greater amount than said developer carrier.

9. An apparatus as claimed in claim 2, wherein said applicator roller means comprises a photogravure roller having a carved surface.

10. An apparatus as claimed in claim 2, wherein said partition includes a portion for providing fluid communication between said feed section and said collection section.

11. An image forming apparatus comprising:

a reservoir storing a viscous and dense developing liquid for developing a latent image electrostatically formed on an image carrier;

a developer carrier for depositing the developing liquid thereon;

an applicator roller for applying the developing liquid to said developer carrier;

circulating means for circulating the developing liquid in said reservoir;

an opening formed in a portion of said reservoir where said developer carrier and said image carrier contact each other; and a partition arranged in said reservoir for separating said reservoir into a feed section for feeding the developing liquid to said applicator roller and a collection section for collecting the developing liquid left on said developer carrier, wherein said developer carrier, said applicator roller and said circulating means are disposed in said reservoir, wherein said circulating means is capable of agitating the developing liquid in said reservoir, further comprising a replenishment port for replenishing one of a fresh developing liquid, fresh toner and a fresh carrier liquid, and wherein said replenishment port is positioned upstream of said circulating means in a direction of circulation of the developing liquid.

12. An image forming apparatus comprising:

a reservoir storing a viscous and dense developing liquid for developing a latent image electrostatically formed on an image carrier;

a developer carrier for depositing the developing liquid thereon;

an applicator roller for applying the developing liquid to said developer carrier;

circulating means for circulating the developing liquid in said reservoir;

an opening formed in a portion of said reservoir where said developer carrier and said image carrier contact each other; and a partition arranged in said reservoir for separating said reservoir into a feed section for feeding the developing liquid to said applicator roller and a collection section for collecting the developing liquid left on said developer carrier, wherein said developer carrier, said applicator roller and said circulating means are disposed in said reservoir, further comprising agitating means disposed in said reservoir for agitating the developing liquid, and wherein said agitating means comprises a restricted portion included in a circulation path for the developing liquid.

13. An apparatus as claimed in claim 12, wherein said circulating means is positioned in said restricted portion and capable of agitating the developing liquid in said reservoir.

14. An apparatus as claimed in claim 13, wherein said restricted portion is positioned at a vertically bottom portion of said circulation path.

15. An image forming apparatus comprising:

a reservoir storing a viscous and dense developing liquid for developing a latent image electrostatically formed on an image carrier;

a developer carrier for depositing the developing liquid thereon;

an applicator roller for applying the developing liquid to said developer carrier;

circulating means for circulating) the developing liquid in said reservoir;

an opening formed in a portion of said reservoir where said developer carrier and said image carrier contact each other; and a partition arranged in said reservoir for separating said reservoir into a feeding the developing liquid to said applicator roller and a collection section for collecting the developing liquid left on said developer carrier, wherein said developer carrier, said applicator roller and said circulating means are disposed in said reservoir, and wherein said developer carrier comprises a hollow cylindrical member, said apparatus further comprising drive means for driving said developer carrier, said drive means having an outside diameter greater than ½ inclusive, but smaller than 9/10 inclusive, of an inside diameter of said developer carrier.

16. An image forming apparatus comprising:

a reservoir storing a viscous and dense developing liquid for developing a latent image electrostatically formed on an image carrier;

a developer carrier for depositing the developing liquid thereon;

an applicator roller for applying the developing liquid to said developer carrier;

circulating means for circulating the developing liquid in said reservoir;

an opening formed in a portion of said reservoir where said developer carrier and said image carrier contact each other; and a partition arranged in said reservoir for separating said reservoir into a feed section for feeding the developing liquid to said applicator roller and a collection section for collecting the developing liquid left on said developer carrier, wherein said developer carrier, said applicator roller and said circulating means are disposed in said reservoir, wherein said partition includes a portion for providing fluid communication between said feed section and said collection section, and wherein said circulating means is positioned in said portion of said partition, said portion of said partition interrupting the fluid communication when said circulating means is not operated.

17. An image forming apparatus comprising:

a reservoir storing a viscous and dense developing liquid for developing a latent image electrostatically formed on an image carrier;

a developer carrier for depositing the developing liquid thereon;

an applicator roller for applying the developing liquid to said developer carrier;

circulating means for circulating the developing liquid in said reservoir;

an opening formed in a portion of said reservoir where said developer carrier and said image carrier contact each other; and a partition arranged in said reservoir for separating said reservoir into a feed section for feeding the developing liquid to said applicator roller and a collection section for collecting the developing liquid left on said developer carrier, wherein said developer carrier, said applicator roller and s circulating means are disposed in said reservoir, and wherein said developer carrier is positioned at a higher level than said applicator roller, said apparatus further comprising a regulating member contacting said applicator roller for regulating an amount of application of the developing liquid to said applicator roller, said regulating member preventing the developing liquid from leaking through a gap between an inner periphery of said reservoir and said applicator roller.

* * * * *